US008514072B2

(12) United States Patent
Crouse et al.

(10) Patent No.: US 8,514,072 B2
(45) Date of Patent: Aug. 20, 2013

(54) UNIVERSAL RF WIRELESS SENSOR INTERFACE

(75) Inventors: Kent E. Crouse, Carpentersville, IL (US); William L. Keith, Lake in the Hills, IL (US); Andrew C. Brown, Carpentersville, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 918 days.

(21) Appl. No.: 12/093,335

(22) PCT Filed: Nov. 13, 2006

(86) PCT No.: PCT/IB2006/054228

§ 371 (c)(1),
(2), (4) Date: May 12, 2008

(87) PCT Pub. No.: WO2007/057835

PCT Pub. Date: May 24, 2007

(65) Prior Publication Data

US 2008/0266050 A1 Oct. 30, 2008

Related U.S. Application Data

(60) Provisional application No. 60/737,174, filed on Nov. 16, 2005.

(51) Int. Cl.
*G08B 1/08* (2006.01)

(52) U.S. Cl.
USPC ..... 340/539.22; 340/539.1; 340/3.1; 315/152; 315/294

(58) Field of Classification Search
USPC ..... 340/3.7, 3.1, 539.1, 539.22; 700/276, 700/19; 315/294, 152
See application file for complete search history.

(56) References Cited

U.S. PATENT DOCUMENTS 5,426,416 A * 6/1995 Jefferies et al. ..... 340/664
5,532,680 A * 7/1996 Ousborne ..... 340/567

(Continued)

FOREIGN PATENT DOCUMENTS

WO WO2004023849 3/2004
WO WO2005015519 2/2005

OTHER PUBLICATIONS

Weatherall et al., "Ubiquitos Networks and Their Applicaiotns", IEEE Peraonal Communications, IEEE Communications Society, US, vol. 9, No. 1, Feb. 2002, pp. 18-29.

*Primary Examiner* — Albert Wong
*Assistant Examiner* — Peter Mehravar
(74) *Attorney, Agent, or Firm* — Van C. Ernest; Mark L. Beloborodov

(57) ABSTRACT

A RF wireless sensor interface (20) interfaces one or more of a variety of sensors (12, 13) to a RF wireless network (11). A power converter (30) of the interface (20) converts a primary power ($P_{PRM}$) into a DC power ($P_{DC}$) that is supplied to the sensor(s) (12, 13). A microcontroller (60) of the interface (20) receives sensor detection information (SDI) from the sensor(s) (12, 13) in response to the sensor(s) (12, 13) receiving the DC power ($P_{DC}$) from the power converter (30). A RF transmitter/transceiver (50) of the interface (20) executes a sensor detection information RF transmission ($SDI_{RF}$) and/or a sensor control signal RF transmission ($SCS_{RF}$) to the RF wireless network (11) in response to the microcontroller (60) receiving the sensor detection information (SDI). The power converter (30), the microcontroller (60) and the RF transmitter/transceiver (50) are located within a modular housing (80).

20 Claims, 3 Drawing Sheets

(56) References Cited

U.S. PATENT DOCUMENTS

| | | | | |
|---|---|---|---|---|
| 6,379,013 | B1 * | 4/2002 | Bechtel et al. | 359/604 |
| 7,135,976 | B2 * | 11/2006 | Neff et al. | 340/572.1 |
| 7,664,573 | B2 * | 2/2010 | Ahmed | 700/276 |
| 2004/0008651 | A1 | 1/2004 | Ahmed | |
| 2004/0018827 | A1 | 1/2004 | Laaser | |
| 2004/0217847 | A1 | 11/2004 | Fries et al. | |
| 2006/0006817 | A1 * | 1/2006 | Chason et al. | 315/291 |
| 2006/0271315 | A1 * | 11/2006 | Cargonja et al. | 702/63 |
| 2008/0266050 | A1 * | 10/2008 | Crouse et al. | 340/3.1 |

* cited by examiner

UNIVERSAL RF WIRELESS SENSOR INTERFACE

CROSS REFERENCE TO RELATED APPLICATIONS

This application claims the benefit of International Application Number PCT/IB2006/054228, filed Nov. 13, 2006 and U.S. Provisional Application Ser. No. 60/737,174 filed Nov. 16, 2005 which are incorporated herein in whole by reference.

FIELD OF THE INVENTION

The present invention generally relates to a variety of sensors for producing sensor detection information necessary to an operation of a radio frequency ("RF") wireless network. The present invention specifically relates to a universal interfacing of the variety of sensors to the RF wireless network.

BACKGROUND OF THE INVENTION

Sensors (e.g., light sensors and occupancy sensors) are widely used in a lighting control system to optimize the light output and energy consumption of the system. One traditional way of implementing a sensor in the lighting control system is to associate the output of the sensor to a relay that controls an on/off switch of a lamp. For example, if an occupancy sensor detects no occupants in a room, it outputs a sensor control signal to affect the relay to switch off the lamp.

If the lighting control system is a RF wireless lighting control system, then the sensor output will be sent out as an RF signal. As such, the sensor needs a RF communication interface. The conventional way of adding a RF communication interface to the sensor is to design a specific circuit module for that individual sensor type. A drawback to this approach is the requirement to design different circuit modules for each individual sensor type when a variety of sensors are to be RF interfaced with the lighting control system.

BRIEF SUMMARY OF THE INVENTION

The present invention overcomes this drawback by providing a new and unique RF wireless sensor interface for interfacing a variety of sensors to a RF wireless network without a need to design a specific RF sensor interface for each particular type of sensor. In one form of the present invention, the RF wireless sensor interface employs a power converter, a microcontroller, a RF transmitter/transceiver and a modular housing. The power converter inputs and converts a primary power into a DC power and supplies the DC power to the sensor(s). The microcontroller receives sensor detection information from the sensor(s) in response to the sensor(s) receiving the DC power from the power converter. The RF transmitter/transceiver executes a sensor detection information RF transmission and/or a sensor control signal RF transmission to the RF wireless network in response to the microcontroller receiving the sensor detection information. The power converter, the microcontroller and the RF transmitter/transceiver are located within the modular housing to facilitate an operably coupling of the variety of sensors to the RF wireless sensor interface.

BRIEF DESCRIPTION OF THE DRAWINGS

The foregoing form and other forms of the present invention as well as various features and advantages of the present invention will become further apparent from the following detailed description of various embodiments of the present invention read in conjunction with the accompanying drawings. The detailed description and drawings are merely illustrative of the present invention rather than limiting, the scope of the present invention being defined by the appended claims and equivalents thereof.

DETAILED DESCRIPTION OF THE INVENTION

Figure 1:
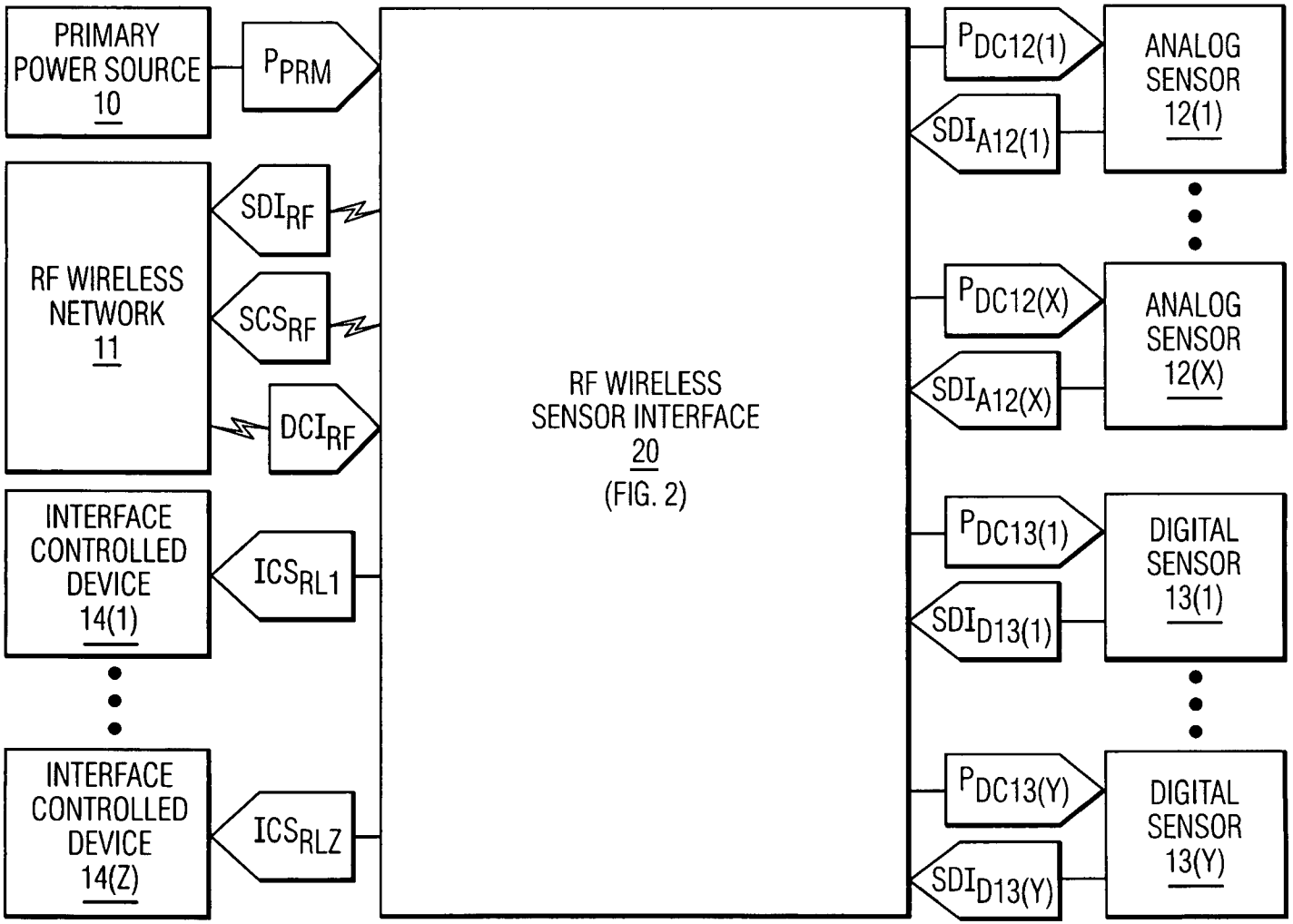
FIG. 1 illustrates a block diagram of RF wireless sensor interface in accordance with the present invention.

A RF wireless sensor interface 20 of the present invention as shown in FIG. 1 is structurally configured to interface a variety of sensors in the form of a X number of analog sensors 12 and a Y number of digital sensors 13 to a RF wireless network 11, where $X \geqq 0$, $Y \geqq 0$ and $X+Y \geqq 1$. Alternatively or concurrently, interface 20 may be structurally configured to interface the X number of analog sensors 12, the Y number of digital sensors 13 and RF wireless network 11 to a Z number of interface controlled devices 14, where $Z \geqq 1$.

For purposes of the present invention, the term "analog sensor" is broadly defined herein as any sensor outputting sensor detection information in analog form.

The term "digital sensor" is broadly defined herein as any sensor outputting sensor detection information in digital form.

The term "sensor detection information" is broadly defined herein as any type of data related to a detection of a physical stimuli (e.g., movement, light and heat) by a sensor.

The term "RF wireless network" is broadly defined herein as any network implementing a RF based communication network protocol.

The term "interface controlled device" is broadly defined herein as any device operable to be switched among a plurality of operational states (e.g., one or more activation states and a deactivation state) as controlled by RF wireless sensor interface 20 based on sensor detection information and/or an interface control information.

And, the term "interface control information" is broadly defined herein any type of data for controlling an operational state of an interface controlled device.

In operation, RF wireless sensor interface 20 converts a primary power $P_{PRM}$ from a primary power source 10 of any type (AC or DC) into a DC power $P_{DC}$ that is supplied to each analog sensor 12 operably coupled via a hardwiring to interface 20 and each digital sensor 13 operably coupled via a hardwiring to interface 20. In response thereto, each analog sensor 12 provides its sensor detection information in analog form $SDI_A$ to interface 20 and each digital sensor 13 provides its sensor detection information in digital form $SDI_D$ to interface 20. An example of an analog sensor 12 is a daylight analog sensor structurally configured to output sensor detection information in the form of a daylight indicator ranging between 0 volts (i.e., a sensing of a highest detectable light level) to 10 volts (i.e., a sensing of a lowest detectable light level). An example of a digital sensor 13 is an occupancy digital sensor (e.g., ultrasound, infrared and/or acoustic) structurally configured to output its sensor detection information in the form of an occupancy indicator equaling either a logic high level "1" for occupied and a logic low level "0" for vacancy.

Upon receiving sensor detection information from one of the sensors, RF wireless sensor interface 20 processes the sensor detection information in accordance with a RF transmission mode or a relay mode. In the RF transmission mode, RF wireless sensor interface 20 processes the sensor detection information in accordance with the RF communication network protocol of RF wireless network 11 to thereby execute a sensor detection information RF transmission $SDI_{RF}$ of the sensor detection information to RF wireless network 11 whereby network 11 utilizes the sensor detection information to control an operation of RF wireless network 11. Alternatively or concurrently, RF wireless sensor interface 20 further processes the sensor detection information in accordance with a network application to thereby execute a sensor control signal RF transmission $SCS_{RF}$ of to RF wireless network 11 whereby RF wireless network 11 is responsive to the sensor control signal to control an operational state of one or more network devices of RF wireless network 11 based on the sensor detection information.

In the relay mode, RF wireless sensor interface 20 further processes the sensor detection information in accordance with a relay application to thereby execute an interface control signal relay $ICS_{RL}$ to one or more interface controlled devices 14 whereby the interface controlled device(s) 14 are responsive to the interface control signal to be switched between operational states based on the sensor detection information.

Upon receiving a device control information RF transmission $DCI_{RF}$ from RF wireless network 11, RF wireless interface 20 process the device control information in accordance with a relay application to thereby execute an interface control signal relay $ICS_{RL}$ to one or more interface controlled devices 14 whereby the interface controlled device(s) 14 are responsive to the interface control signal to be switched between operational states based on the device control information received from RF wireless network 11 by RF wireless sensor interface 20.

In one embodiment, RF wireless interface 20 process the sensor detection information and the device control information in accordance with a relay application to thereby execute an interface control signal relay $ICS_{RL}$ to one or more interface controlled devices 14 whereby the interface controlled device(s) 14 are responsive to the interface control signal to be switched between operational states based on the sensor detection information and the device control information.

Figure 2:
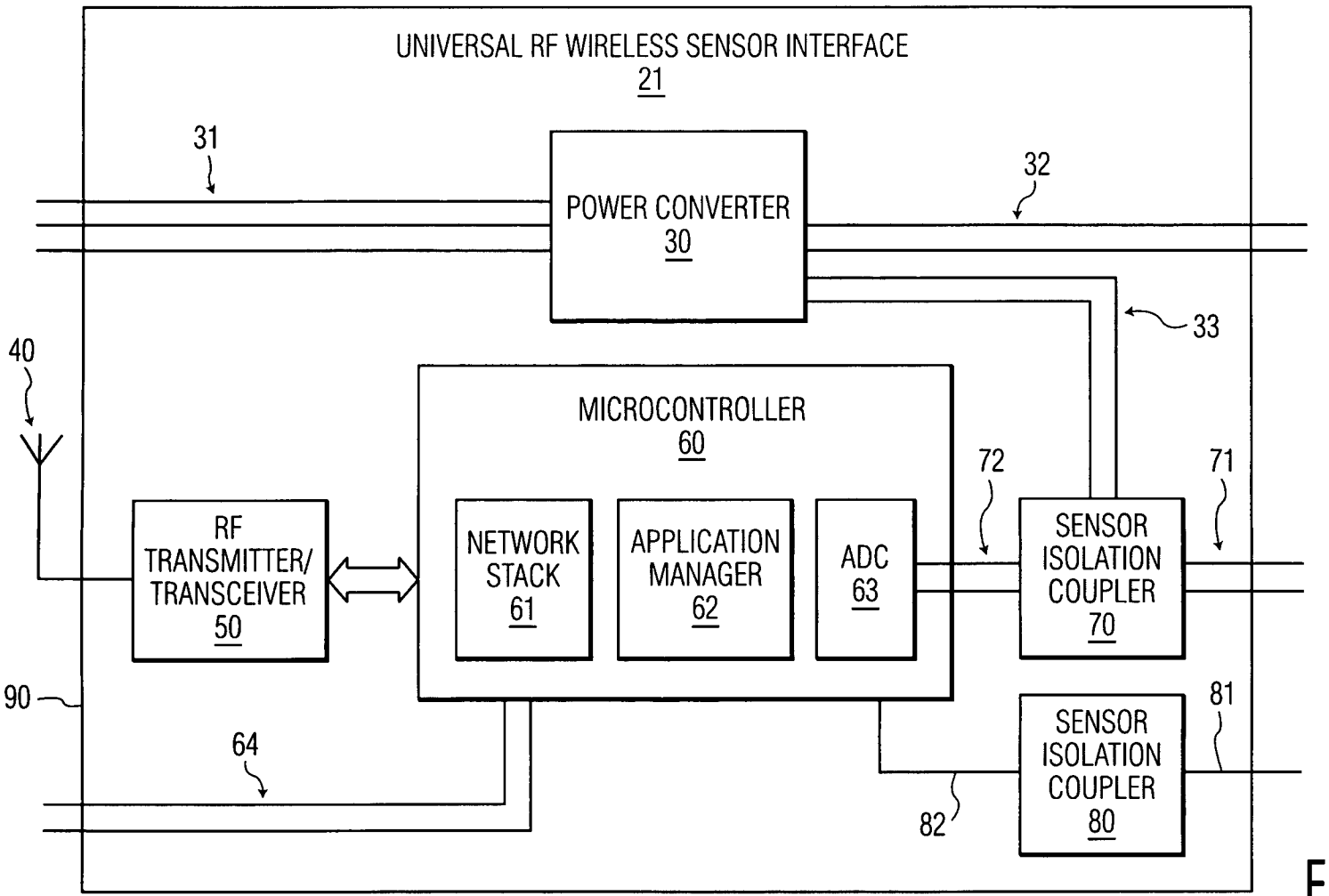
FIG. 2 illustrates a block diagram of an exemplary embodiment of the RF wireless sensor interface illustrated in FIG. 1 in accordance with the present invention.

FIG. 2 illustrates an exemplary embodiment 21 of interface 20 (FIG. 1) for interfacing one analog sensor 12 (FIG. 1) in the form of a light sensor and one digital sensor 13 (FIG. 1) in the form of an occupancy sensor to a RF wireless network 11 (FIG. 1) in the form of a RF wireless lighting control network and one interface controlled device 14 (FIG. 1) in the form of a lamp of a painting. As shown, a power converter 30 has three (3) power lead lines 31 (e.g., a line, a neutral and a ground) for receiving an AC power (e.g., a mains AC power) from a AC power source to thereby convert the AC power to a DC power.

Power converter 30 further has a pair of output power lead lines 32 (e.g. +24 volts and 24 volt return) for providing the DC power to the occupancy sensor, which in response thereto provides sensor detection information in digital form to a microcontroller 60 via a sensor isolation coupler 80 having a sensor control input line 81 coupled to the occupancy sensor and a sensor control output line 82 coupled to microcontroller 60.

Power converter 30 further has a pair of output power lead lines 33 for providing the DC power to the light sensor via a sensor isolation coupler 70 having a pair of sensor control lines 71 (e.g., positive control and negative control) coupled to the light sensor, which in response thereto provides sensor detection information in analog form to an analog-to-digital converter ("ADC") 63 of microcontroller 60 via a pair of sensor output lines 72 coupled to ADC 63.

Power converter 30 also powers the other components of RF wireless sensor interface 21 as would be appreciated by those having ordinary skill in the art.

Microcontroller 60 employs an application manager 62 that is structurally configured to process the sensor detection information from the light sensor in accordance with a network application and a relay application as needed, and to process the device control information received from RF wireless network 11. Microcontroller 60 further employs a network stack 61 that is structurally configured for processing any portion of the sensor detection information and any generated sensor control signal to be transmitted to network 11 in accordance with the RF communication network protocol associated with RF wireless network 11, and to process any portion of device control information received from RF wireless network 11 in accordance with the RF communication network protocol associated with RF wireless network 11

RF transmitter/transceiver 50 (i.e., a transmitter or a transceiver) executes a sensor detection information RF transmission $SDI_{RF}$ (FIG. 1) via an antenna 40 of sensor detection information to RF wireless network 11 as controlled by microcontroller 60 in response to receiving the sensor detection information from the occupancy sensor.

RF transmitter/transceiver 50 further executes a sensor control signal RF transmission $SCS_{RF}$ (FIG. 1) via antenna 40 of a sensor control signal to wireless network 11 as controlled by microcontroller 60 in response to receiving the sensor detection information from the light sensor.

RF transmitter/transceiver 50 further executes a device control signal RF reception $DCI_{RF}$ (FIG. 1) via antenna 40 of device control information from RF wireless network 11.

Microcontroller 60 can execute an interface control signal relay $ICS_{RL}$ (FIG. 1) via a pair of relay lines 64 to the interface controlled device 14 in response to receiving the sensor detection information from one of the sensors and/or the device control information from RF wireless network 11.

Power converter 30, RF transmitter/transceiver 50, microcontroller 60, coupler 70 and coupler 80 are located within a modular housing 90 to facilitate the operably coupling of the occupancy sensor and the light sensor to RF wireless sensor interface 21.

Figure 3:
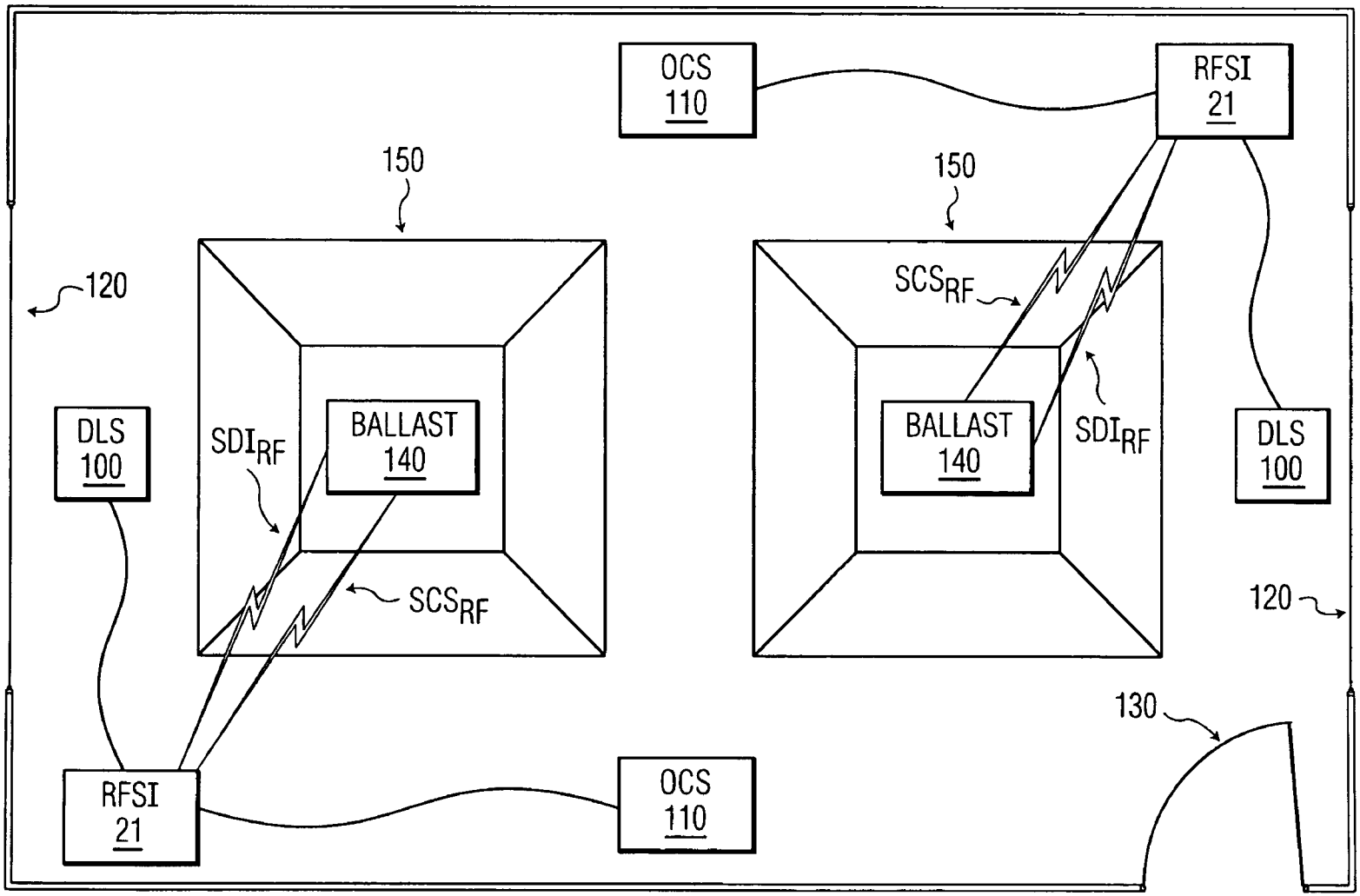
FIG. 3 illustrates an exemplary network interfacing of the RF wireless sensor interface illustrated in FIG. 2 in accordance with the present invention.

To facilitate a further understanding of the present invention, FIG. 3 illustrates an office space employing a lighting control on each side of the room with each lighting control employing a daylight analog sensor 100 and a occupancy digital sensor 110 interfaced via an RF wireless sensor interface 21 to RF wireless network consisting of a ballast 140 controlling a four (4) lamp device 150.

In operation, each daylight analog sensor 100 is powered by its associated RF wireless sensor interface 21 as previously taught herein to thereby sense a quantity of daylight propagating through an associated window 120 and to provide sensor detection information in the form of a daylight indicator to its associated RF wireless sensor interface 21. In turn, the RF wireless sensor interface 21 executes a sensor detection information RF transmission $SDI_{RF}$ of the daylight indicator via antenna 40 (FIG. 2) to its associated ballast 140 whereby ballast 150 can control a dimming level of lamp device 150 based on the daylight indicator.

Similarly, each occupancy digital sensor 110 is powered by its associated RF wireless sensor interface 21 as previously taught herein to thereby sense an occupancy level of the office relative to people entering and existing an office door 130 and to provide sensor detection information in the form of an occupancy indicator to its associated RF wireless sensor interface 21. In turn, the RF wireless sensor interface 21 generates a sensor control signal as a function of the network application and executes a sensor control signal RF transmission $SCS_{RF}$ of the sensor control signal via antenna 40 to its associated ballast 140 whereby ballast 140 and lamp device 150 are activated or deactivated based on the sensor control signal. For example, the sensor control signal will activate ballast 140 and lamp device 150 if the occupancy indicator represents an occupied office. Otherwise, the sensor control signal will deactivate ballast 140 and lamp device 150 if the occupancy indicator represents a vacant office.

Also by example, although not shown in FIG. 3 for clarity purposes, one of the RF wireless sensor interfaces 21 can also be wired via relay lines 64 (FIG. 2) to an interface controlled device like a stand-alone lamp whereby the lamp is turned on if the daylight indicator represents a nighttime detection and the occupancy indicator represents an occupied office and whereby the lamp is turned off if the daylight indicator represents a daytime detection and/or the occupancy indicator represents a vacant office.

Referring to FIGS. 1-3, those having ordinary skill in the art will appreciate numerous advantages of the present invention including, but not limited to, providing a variety of sensors (particularly off-the-shelf sensors) with a simultaneous use of RF wireless communication capability with a RF wireless network.

While the embodiments of the present invention disclosed herein are presently considered to be preferred, various changes and modifications can be made without departing from the spirit and scope of the present invention. The scope of the present invention is indicated in the appended claims, and all changes that come within the meaning and range of equivalents are intended to be embraced therein.

We claim:

1. An RF wireless sensor interface configured to interface with a plurality of sensors comprising a variety of sensor types, to an RF wireless network, the RF wireless sensor interface comprising:

a power converter configured to convert primary power ($P_{PRM}$) into DC power and to supply the DC power to the plurality of sensors;

a first sensor isolation coupler configured to receive analog sensor detection information from a first sensor of the plurality of sensors comprising a first sensor type, the first sensor configured to convey sensor detection information to an analog-to-digital converter;

a second sensor isolation coupler configured to receive digital sensor detection information from a second sensor of the plurality of sensors comprising a second sensor type;

a microcontroller configured to receive the analog sensor detection information from the first sensor isolation coupler via an analog-to-digital converter in response to the first sensor receiving the DC power from the power converter, and to receive the digital sensor detection information from the second sensor isolation coupler in response to the second sensor receiving the DC power from the power converter;

an RF transceiver configured to perform a sensor detection information RF transmission ($SDI_{RF}$) for providing sensor detection information corresponding to the analog sensor detection information or the digital sensor detection information in accordance with a RF wireless network protocol, and a sensor control signal RF transmission ($SCS_{RF}$) for providing a sensor control signal provided by the microcontroller processing the analog sensor detection information or the digital sensor detection information in accordance with a network application to the RF wireless network, in an RF transmission mode; and a modular housing, wherein the power converter, the microcontroller, the first sensor isolation coupler, the second sensor isolation coupler, and the RF transceiver are located within the modular housing to facilitate an operable coupling of the variety of sensors to the RF wireless sensor interface, wherein the microprocessor is further configured to provide an interface control signal relay ($ICS_{RL}$) to an interface controlled device by processing the analog sensor detection information or the digital sensor detection information in accordance with a relay application in a relay mode.

2. The RF wireless sensor interface of claim 1, wherein the microcontroller is further configured to provide the interface control signal relay ($ICS_{RL}$) to the interface controlled device in response to the microcontroller receiving the analog and digital sensor detection information.

3. The RF wireless sensor interface of claim 1, wherein the microcontroller is further configured to provide the interface control signal relay ($ICS_{RL}$) to the interface controlled device in response the RF transceiver receiving a device control information RF transmission ($DCI_{RF}$) from the RF wireless network.

4. The RF wireless sensor interface of claim 1, wherein the microcontroller includes a network stack configured to facilitate control by the microcontroller of the sensor detection information RF transmission ($SDI_{RF}$) to the RF wireless network by the RF transceiver in accordance with the RF wireless network protocol associated with the RF wireless network and the sensor control signal RF transmission ($SCS_{RF}$) to the RF wireless network by the RF transceiver in accordance with the application associated with the RF wireless network.

5. The RF wireless sensor interface of claim 1, wherein the microcontroller includes an application manager configured to generate at least one of the sensor control signal as a function of the network application of the RF wireless network and the interface control signal relay ($ICS_{RL}$) as a function of the relay application of the interface controlled device.

6. The RF wireless sensor interface of claim 1, wherein the primary power ($P_{PRM}$) is a mains AC power.

7. The RF wireless sensor interface of claim 1, wherein the RF wireless network is a wireless lighting control network.

8. The RF wireless sensor interface of claim 1, wherein the RF wireless network is a wireless building automation network.

9. The RF wireless sensor interface of claim 1, wherein the first sensor comprises a daylight analog sensor, and the second sensor comprises an occupancy digital sensor.

10. An RF wireless sensing system, comprising:

a plurality of sensors comprising a variety of sensor types; and an RF wireless sensor interface comprising:

a power converter configured to convert a primary power ($P_{PRM}$) into DC power ($P_{DC}$) and to supply the DC power ($P_{DC}$) to the plurality of sensors;

a first sensor isolation coupler configured to receive analog sensor detection information ($SDI_A$) from a first sensor of the plurality of sensors;

a second sensor isolation coupler configured to receive digital sensor detection information ($SDI_D$) from a second sensor of the plurality of sensors;

a microcontroller configured to receive the analog sensor detection information from the first sensor isolation coupler via an analog-to-digital converter in response to the first sensor receiving the DC power from the power converter, and to receive the digital sensor detection information from the second sensor isolation coupler in response to the second sensor receiving the DC power from the power converter;

an RF transceiver configured to perform a sensor detection information RF transmission for providing sensor detection information corresponding to the analog sensor detection information or the digital sensor detection information in accordance with a RF wireless network protocol, and a sensor control signal RF transmission for providing a sensor control signal provided by the microcontroller processing the analog sensor detection information or the digital sensor detection information in accordance with a network application to the RF wireless network, in an RF transmission mode; and a modular housing containing the power converter, the microcontroller, the first sensor isolation coupler, the second sensor isolation coupler, and the RF transceiver to facilitate an operable coupling of the plurality of sensors to the RF wireless sensor interface, wherein the microprocessor is further configured to provide an interface control signal relay to an interface controlled device by processing the analog sensor detection information or the digital sensor detection information in accordance with a relay application in a relay mode.

11. The RF wireless sensing system of claim 10, wherein the microcontroller is further configured to provide the interface control signal relay to the interface controlled device in response to the microcontroller receiving at least one of the analog sensor detection information or the digital sensor detection information.

12. The RF wireless sensing system of claim 10, wherein the microcontroller is further configured to provide the interface control signal relay to the interface controlled device in response the RF transceiver receiving a device control information RF transmission from the RF wireless network.

13. The RF wireless sensing system of claim 10, wherein the microcontroller includes a network stack configured to facilitate control by the microcontroller of the sensor detection information RF transmission to the RF wireless network by the RF transceiver in accordance with the RF wireless network protocol associated with the RF wireless network and the sensor control signal RF transmission to the RF wireless network by the RF transceiver in accordance with the application associated with the RF wireless network.

14. The RF wireless sensing system of claim 10, wherein the microcontroller includes an application manager configured to generate at least one of the sensor control signal as a function of the network application of the RF wireless network and the interface control signal relay as a function of the relay application of the interface controlled device.

15. The RF wireless sensing system of claim 10, wherein the primary power is a mains AC power.

16. The RF wireless sensing system of claim 10, wherein the RF wireless network is a wireless lighting control network.

17. The RF wireless sensing system of claim 10, wherein the RF wireless network is a wireless building automation network.

18. The RF wireless sensing system of claim 10, wherein the first sensor comprises a daylight analog sensor, and the second sensor comprises an occupancy digital sensor.

19. A radio frequency (RF) sensor interface, comprising:

a power converter configured to convert primary power into DC power, and to supply the DC power to an analog sensor and a digital sensor in communication with the RF sensor interface;

a first sensor isolation coupler configured to receive analog sensor detection information from the analog sensor;

a second sensor isolation coupler configured to receive digital sensor detection information from the digital sensor;

a microcontroller configured to receive the analog sensor detection information from the first sensor isolation coupler via an analog-to-digital convertor and the digital sensor detection information from the second sensor isolation coupler in response to the analog sensor and the digital sensor receiving the DC power from the power converter, respectively, to process the analog and digital sensor detection information to provide a sensor control signal in accordance with a network application, and to process the analog and digital sensor detection information to provide an interface control signal relay in accordance with a relay application; and an RF transceiver configured to transmit the sensor control signal provided by the microcontroller to an RF wireless network as a sensor control signal RF transmission, and to transmit one of the analog sensor detection information and the digital sensor detection information to the RF wireless network as a sensor detection information RF transmission in accordance with an RF wireless network protocol, wherein the microcontroller is further configured to output the interface control signal relay to an interface controlled device, bypassing the RF transceiver, in accordance with the relay application.

20. The RF sensor interface of claim 19, wherein the RF transceiver is further configured to receive device control information from the RF wireless network, and the microprocessor is further configured to process the device control information to provide an interface control signal relay in accordance with the relay application.

* * * * *